United States Patent [19]

Landwehr

[11] Patent Number: 4,512,272

[45] Date of Patent: Apr. 23, 1985

[54] SEWING MACHINE REVERSIBLE FEEDING MECHANISM

[75] Inventor: Günter Landwehr, Bielefeld, Fed. Rep. of Germany

[73] Assignee: Kochs Adler AG, Bielefeld, Fed. Rep. of Germany

[21] Appl. No.: 476,219

[22] Filed: Mar. 17, 1983

[30] Foreign Application Priority Data

Mar. 25, 1982 [DE] Fed. Rep. of Germany ..... 3210997

[51] Int. Cl.[3] ..... D05B 27/06

[52] U.S. Cl. ..... 112/311; 112/323

[58] Field of Search ..... 112/322, 323, 311, 310, 112/312, 313, 314, 220

[56] References Cited

U.S. PATENT DOCUMENTS 4,187,795 2/1980 Norton ..... 112/322 X
4,271,776 6/1981 Landwehr et al. ..... 112/318 X
4,413,582 11/1983 Landwehr et al. ..... 112/311

*Primary Examiner*—Werner H. Schroeder
*Assistant Examiner*—Andrew M. Falik
*Attorney, Agent, or Firm*—Max Fogiel

[57] ABSTRACT

A feed gear of a sewing machine for reversibly driving a rotary feed dog, as for example, a conveyor belt, a chain or a feed wheel, having a first gear part for producing an oscillating movement, and a second gear part for converting the oscillating movements into reversible intermittent rotary movements. The second gear part is provided with oppositely arranged driven one-way couplings.

13 Claims, 13 Drawing Figures

Fig.1
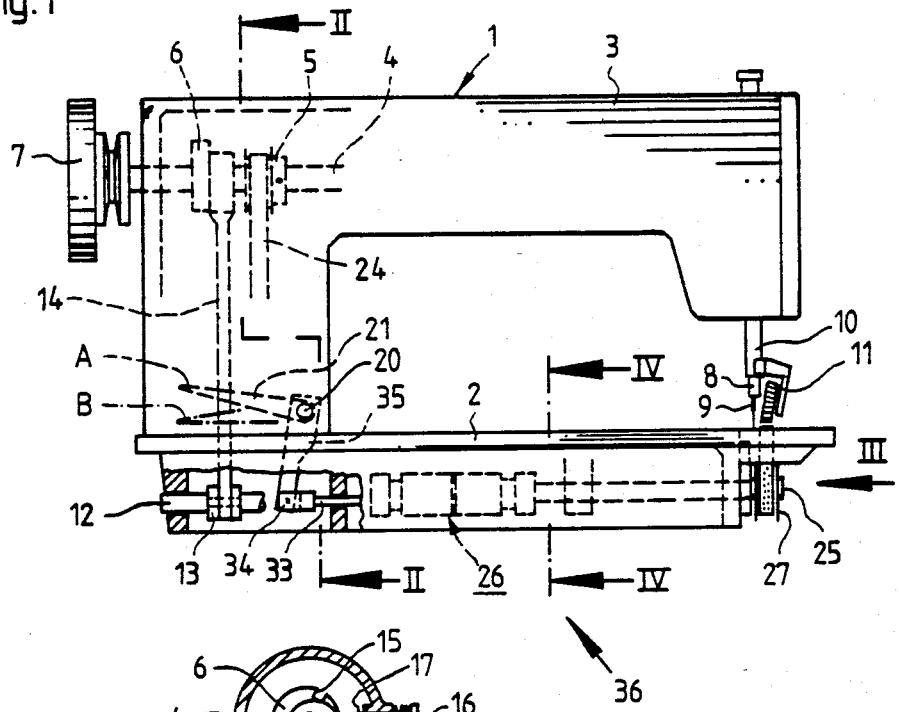
Fig.2
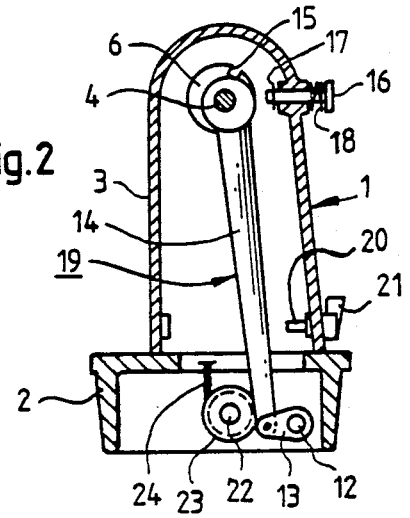
Fig. 3
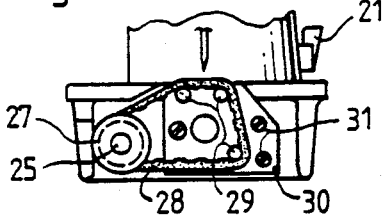
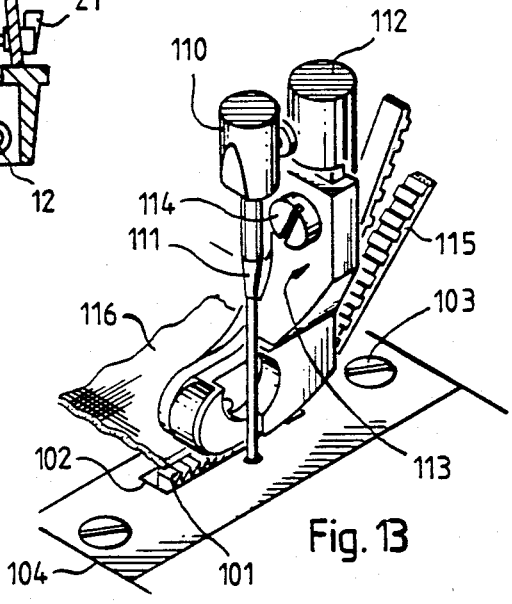
Fig. 13

Fig. 4
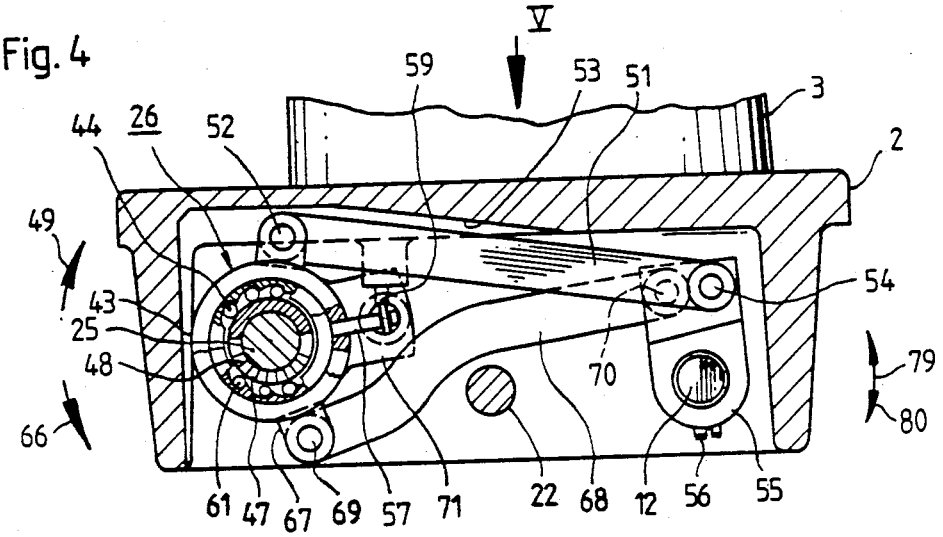
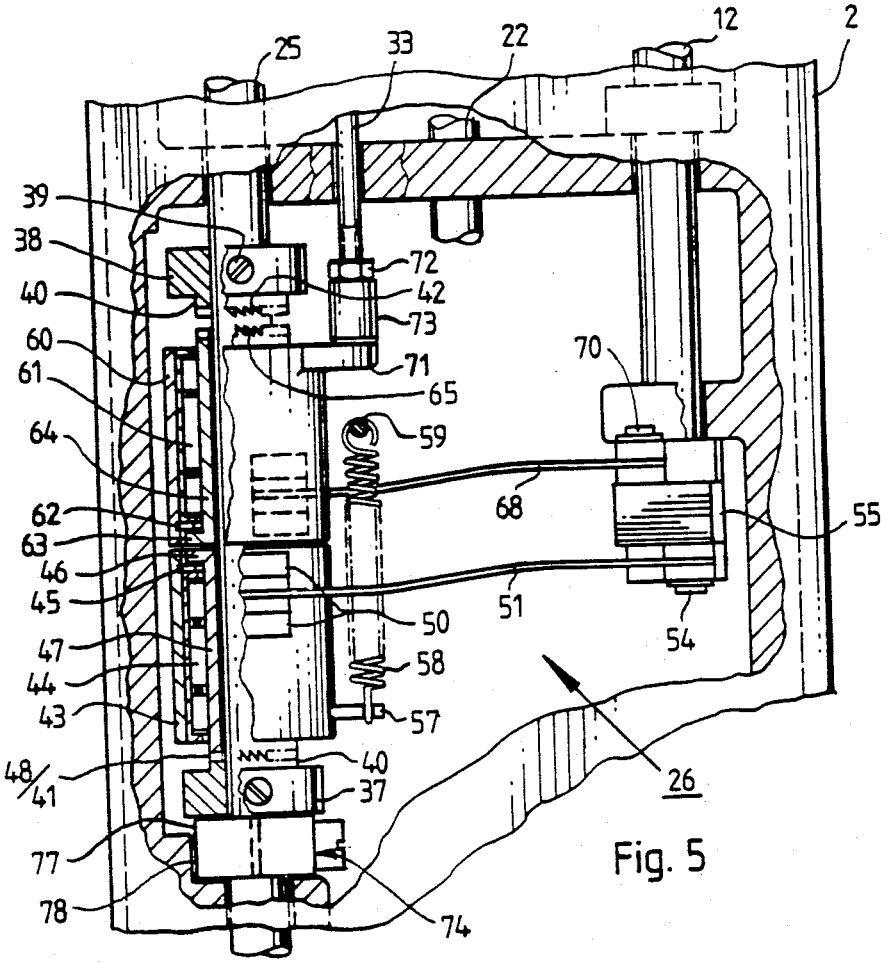
Fig. 5

Fig. 6
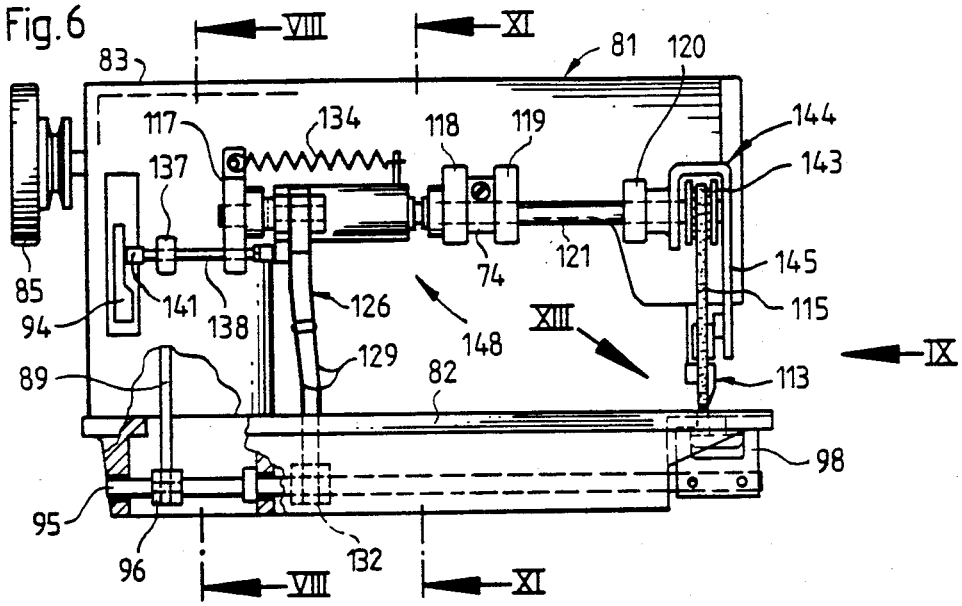
Fig. 8
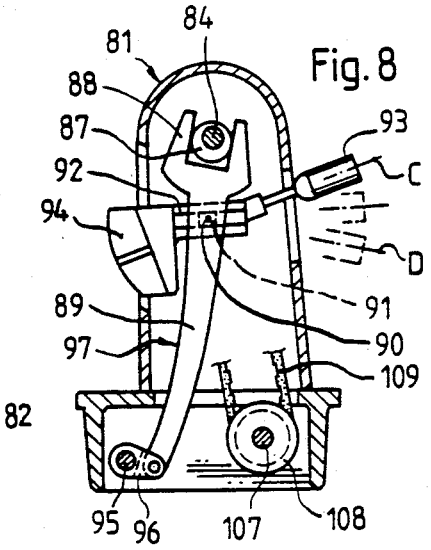
Fig. 9
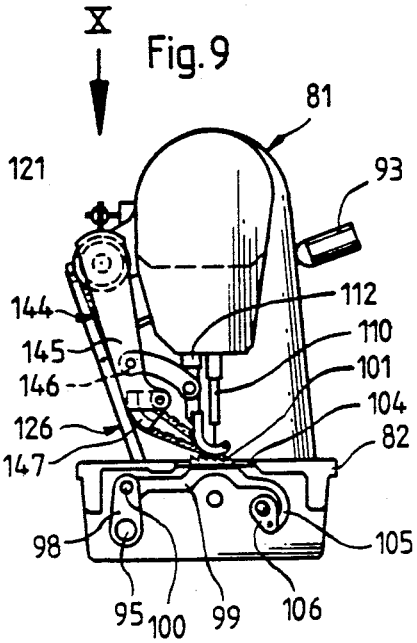
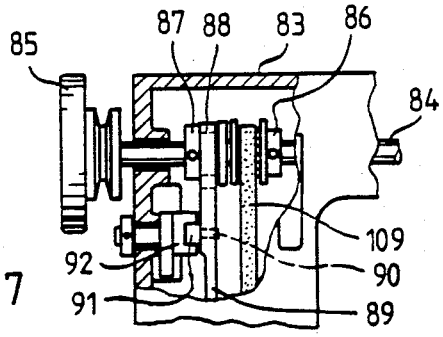
Fig. 7

Fig. 10
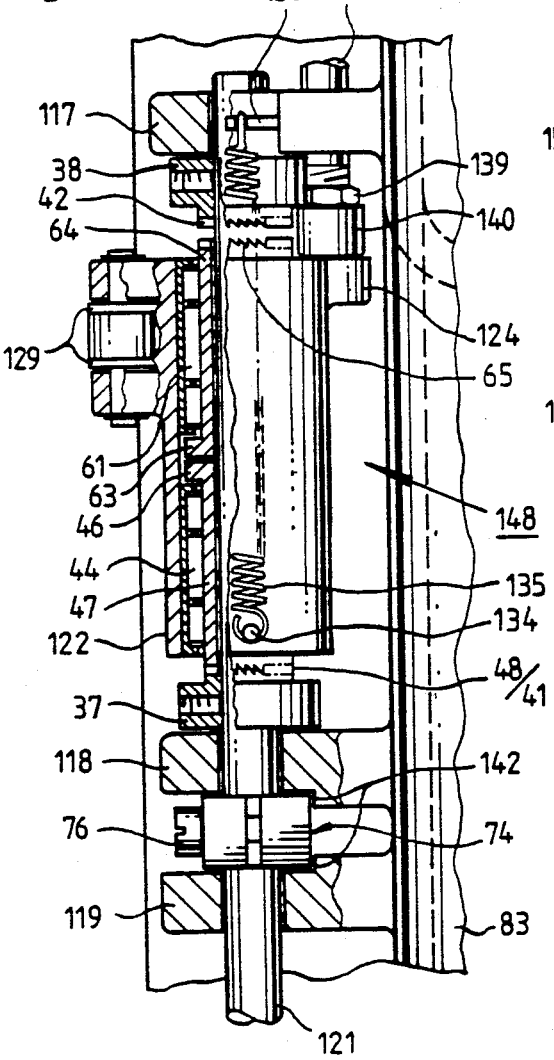
Fig. 11
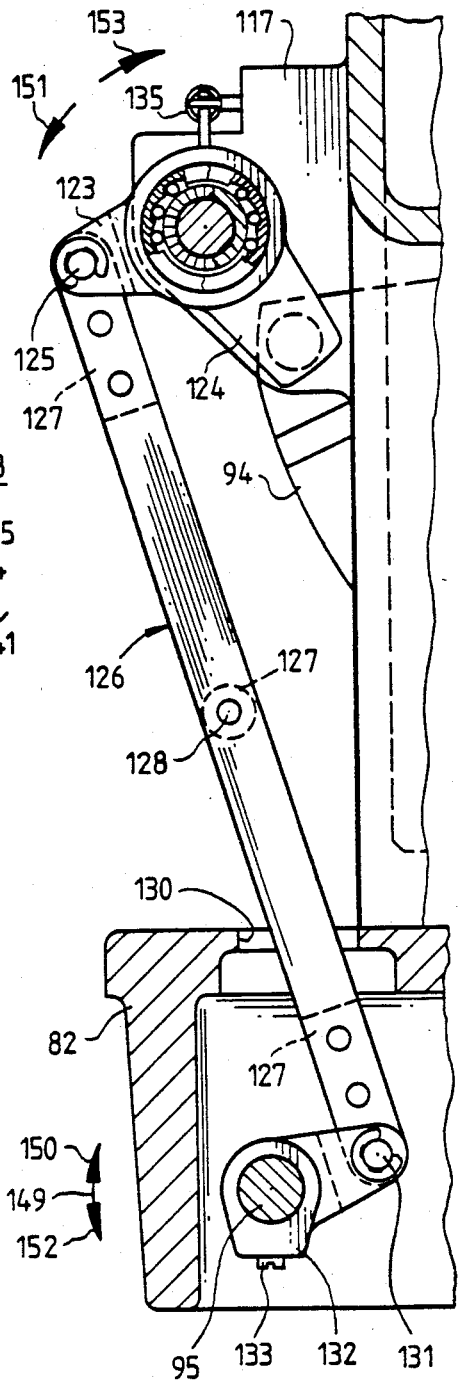
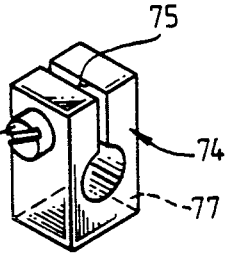
Fig. 12

SEWING MACHINE REVERSIBLE FEEDING MECHANISM

BACKGROUND OF THE INVENTION

The present invention relates to improvements of a workpiece feeding device in a sewing machine, which, in particular, is installed with an endless feeding member such as a feed wheel, a feed belt or a feed chain steadily contacting a workpiece.

In U.S. Pat. No. 4,271,776 there is disclosed a sewing machine having a feeding device with such an endless feeding member intermittently driven by employing a one-way coupling in combination with a reversing gear device. As the one-way coupling is applied for converting an oscillating movement into an intermittent rotating movement of one direction, the reversing gear device serves for reversing the intermittent movement to make possible reversal of the feed movement for the workpiece to be sewn.

The reversing gear device of this known feeding device incorporates a clutch and gears for reversing the movement at which both elements are exposed to wear. Furthermore, the known feeding device is composed of an extensive number of elements of high quality so that this feeding device cannot be produced at low cost.

In U.S. Pat. No. 3,141,428 there are employed one-way couplings in a plurality of arrangements in which the individual couplings are separately and in different phases driven so as to generate a quasi rotating movement. To achieve such a movement a uni-directional arrangement of the couplings is necessary, i.e. the one-way couplings are arranged so as to transmit a torque in a common direction. By arranging one-way couplings in this manner, the reversing of the output movement may be achieved only with the application of a reversing gear device, as disclosed in the first-mentioned U.S. patent.

SUMMARY OF THE INVENTION

It is a primary object of the present invention to provide a reversible feed gear for an upper endless feeding member of a sewing machine which is inexpensive to produce, and is reliable in operation.

Another object of the present invention is to provide a precisely working feed gear of the aforesaid type having a low inertia and a minimum of shift distance. Thus, the shifting may be carried out during the operation at a reduced shifting time.

Another object of the present invention is the provision of a feed gear of the aforementioned type having a space saving construction.

Still another object of the present invention is to provide a reversible feeding mechanism which also may be combined with a feeding device having a four-motion feed dog.

The above listed objects are achieved by oppositely arranging one-way couplings which are alternately engagable to the endless feeding mexber.

The feed gear according to the present invention is composed of a minimum number of parts having a simple construction and thus a very low cost for the manufacture of parts as well as assembly is achieved. Furthermore, the new feed gear operates almost without any lubrication and does not require any shielding. Due to the employment of a few drive elements only the feed gear according to the present invention has a low inertia and is connected to a minimum of wear by which a high reliability in operation is achieved. According to the modified embodiment, the endless feeding member driven by oppositely arranged and alternatively engagable one-way couplings may be combined with a four-motion feed dog known in the art. As such four-motion feed dogs are frequently driven by mechanisms which make possible an adjustment as feed rate or feed direction, such combined feeding mechanisms are best suited for sewing operations including a stitch securing by backtacking, where the regular stitch length differs from the tack stitch length.

Other objects, advantages and features of the present invention will appear from the detailed description of the preferred and modified embodiments which will now be described in conjunction with the accompanying drawings.

BRIEF DESCRIPTION OF THE DRAWINGS

FIG. 1 is a rear plan view of a sewing machine provided with a feed gear of a preferred exbodiment of the present invention;

FIG. 2 is a sectional view of the sewing machine taken along line II—II of FIG. 1;

FIG. 3 is a view of the sewing machine in the direction of the arrow III in FIG. 1;

FIG. 4 is a sectional view of the sewing machine taken along line IV—IV in FIG. 1;

FIG. 5 is a partial sectional view of the sewing machine in the direction of the arrow V in FIG. 4;

FIG. 6 is a rear view of another sewing machine provided with a feed gear of a modified embodiment for driving an upper rotary feed dog;

FIG. 7 shows a partial view of the sewing machine illustrated in FIG. 6, in which the sewing machine housing is partially broken away;

FIG. 8 is a sectional view of the sewing machine taken along line VIII—VIII in FIG. 6;

FIG. 9 is a side elevation of the sewing machine in the direction of the arrow IX in FIG. 6;

FIG. 10 is a partial enlarged view of the feed gear in the direction of the arrow X in FIG. 9;

FIG. 11 is a partial sectional view of the sewing machine taken along line XI—XI in FIG. 6, on an enlarged scale;

FIG. 12 is a perspective view of a component of the feed gear according to the embodiment; and FIG. 13 is a perspective view of the stitch forming area of the sewing machine in the direction of arrow XIII in FIG. 6, on an enlarged scale.

DESCRIPTION OF THE PREFERRED EMBODIMENTS

FIGS. 1 to 5 refer to a sewing machine 1 formed with a base plate 2 and an arm 3 for pivotally receiving a shaft 4. Connected to shaft 4 is a timing belt pulley 5 and an adjustable eccentric 6. One end of the shaft 4 is provided with a handwheel 7, while the other end terminates in a crank gear (not shown) for driving a needle bar 8 carrying a needle 9. In the arm 3 there is displaceably supported a presser foot bar 10, to which is fastened a roller foot 11.

In the base plate 2 there is pivoted a rocking shaft 12 provided with a fork 13. The fork 13 and the adjustable eccentric 6 are connected by a tie rod 14. The adjustable eccentric 6 is formed with an adjusting member (not specified) having a groove 15. An adjusting knob 16 is displaceably received in the arm 3 in the plane of the shaft 4 (FIG. 2) and secured against the force of a spring 18 by means of a retaining ring 17. The afore-described driving connection of the shaft 4 with the rocking shaft 12 by means of the adjustable eccentric 6, the tie rod 14 and the fork 13 is hereinafter denoted as a first gear part 19.

In the area of the base plate 2, the arm 3 is provided with a pivotally attached adjusting shaft 20, which terminates outside of the arm 3 in an adjusting lever 21. In the base plate 2 there is pivotally received a shaft 22 carrying a timing belt pulley 23, which cooperates with the timing belt pulley 5 via a timing belt 24. In the base plate 2 there is further located a shaft 25 which connects a second gear member 26 with a timing belt pulley 27 for receiving a toothed conveyor belt 28. A plate 30 is secured by means of screws 31 to the base plate 2 and formed with pivotally attached guide rollers 29 (FIG. 3). Moreover, the base plate 2 is provided with a displaceable shift rod 33 having a forked piece 34 which is engagably connected to a lever 35 secured to the adjusting shaft 20.

The first gear part 19 and the second gear part 26 together with the shifting elements connected to the adjusting lever 21 form a feed gear 36.

According to FIGS. 4 and 5, two identically formed collars 37, 37 are secured to the shaft 25 by setscrews 39. The collars 37, 38 are provided with lugs 40 formed with saw-tooth-shaped and radially extending toothings 41, 42. Into a housing 43 there is pressed a one-way coupling 44 integrated with two needle bearings (not denoted) (type Torrington). In the housing 43 there is located a retaining ring 45, against which rotatably rests a shoulder 46 of an inner ring 47 received in the one-way coupling 44. The inner ring 47 is formed at its front face with a saw-tooth-shaped toothing 48 directed so as to mesh with the toothing 41 of the collar 37. Thus, the toothing 41 of the collar 37 transmits a torque as the housing 43 rotates in the direction of the arrow 49 via the teeth directed in parallel to the shaft 25. Moreover, the housing 43 is provided with a fork 50 for hingedly receiving a flexible tie rod 51 by means of a bolt 52. In the area of the tie rod 51 and the fork 50 the base plate 2 is formed with a recess 53. The free end of the tie rod 51 is hingedly connected via a bolt 54 to an off-drive lever 55 of the first gear part 19. The off-drive lever 55 is secured to the rocking shaft 12 by means of setscrews 56.

The housing 43 is provided with a pin 57 for receiving a spring 58 which is suspended with its other end at a pin 59 located in the base plate 2. The afore-described unit substantially comprising the housing 43, the one-way coupling 44 and the inner ring 47, is rotatably and displaceably received on the shaft 25.

In a housing 60 there are accommodated a one-way coupling 61 built as the one-way coupling 44, and a retaining ring 62, against which rotatably rests a shoulder 63 of an inner ring 64.

The inner ring 64 corresponds to the inner ring 47, the front side toothing of which is denoted as a toothing 65 for clear description of operation. The engagable toothings 65 and 42 are formed so as to transmit a torque via the teeth surfaces directed in parallel to the shaft 25 as the housing 60 rotates in the direction of the arrow 66. According to FIG. 5, the inner ring 64 is rotatably and displaceably received on the shaft 25, at which again the inner ring 64 is received in the one-way coupling 61 pressed into the housing 60.

At its circumference the housing 60 is formed with a fork 67 for hingedly receiving a flexible offset tie rod 68 by means of a bolt 69. The free end of the tie rod 68 is hingedly connected to the off-drive lever 55 by means of a bolt 70. Moreover, the housing 60 is formed with a radially extending nose 71, against which rests a thrust piece 73 secured to the shift rod 33 by means of a nut 72. On the shaft 25 there is arranged a clamping member 74 formed with a slot 75 and a screw 76 (FIGS. 5 and 12). The clamping member 74 rests with its outer surface 77 against a recess 78 of the base plate 2.

The operation of the aforementioned feed gear may be described as follows:

When driving the sewing machine 1 by means of the handwheel 7, the shaft 4 is rotated, thus oscillatorily driving the rocking shaft 12 in the direction of the double arrow 79 by means of the adjustable eccentric 6 and the tie rod 14. The oscillatory movements are transmitted to the housings 43 and 60 via the off-drive lever 55 and the two tie rods 51, 68. When the off-drive lever 55 is moved in the direction of the arrow 80, the tie rods 51 and 68 are exposed to a pull. Due to the oppositely arranged one-way couplings 44, 61, the inner rings 47, 64 are frictionally driven, at which time the inner ring 47 is moved in the direction of the arrow 49 and the inner ring 64 is moved in the direction of the arrow 66. According to the shift condition illustrated in FIG. 5, the inner ring 64 idles on the shaft 25 while the inner ring 47 transmits its movement via the toothings 41, 48 to the collar 37, so that the shaft 25 is driven in the direction of the arrow 49. The shaft 25 transmits the movement via the timing belt pulley 27 to the conveyor belt 28, which moves a workpiece (not denoted) with the action of the roller foot 11 in a feed direction normally denoted as reverse movement. For performing such a reverse movement, the adjusting lever 21 depressed by the operator is locked in the shift position B (FIG. 1), at which time the oscillatingly driven housings 43 and 60 are kept axially displaced against the force of the spring 58 by means of the shift rod 33 or the thrust piece 73 and the nose 71, so that the toothings 41 and 48 are engaged and the toothings 42 and 65 are disengaged. The flexible tie rods 51, 68 permit the axial displacement of the housings 43, 60 for shifting over. When releasing the adjusting lever 21, the latter takes in the shift position A by the action of the spring 58. Simultaneously, the spring 58 causes the two housings 43, 60 to be displaced back, so that the toothings 41, 48 are disengaged and the toothings 42, 65 are engaged. Also in this shift position, the tie rods 51, 68 are exposed to a pull. By the transmission of the torque via the actuated one-way coupling 61, the shaft 25 is moved in the direction of the arrow 66 finally effecting the workpiece to be advanced forwardly. When turning the shaft 25, the each engaged one-way coupling 44 or 61 overcomes the frictional torque induced by the clamping member 74. As the each engaged one-way coupling 44 or 61 is swung back, the shaft 25 is kept in its angular position due to the frictional torque of the clamping member 74. On one hand the frictional torque adjustable by the screw 76 forms a basic load for the one-way couplings 44 or 61. The basic load is constant and independent of the torque for advancing the workpiece as, on the other hand, the frictional torque prevents the feed elements from uncontrolled overriding due to inertia. By adjusting the adjustable eccentric 6 located on the arm shaft 6, the feed rate may be altered during standstill of the automatic sewing machine.

In a modified embodiment (FIGS. 6 to 13) a sewing machine 81 has a base plate 82 and an arm 83 pivotally receiving a shaft 84 with a handwheel 85. To the shaft 84 there are fastened a timing belt pulley 86 and an eccentric 87 surrounded by a fork 88 of a tie rod 89. The tie rod 89 is formed with a lug 90 carrying a slide block 91 which is received in a guide block 92 adjustably supported in the arm 83. The guide block 92 is formed with an adjusting lever 93 projecting through the wall of the arm 83 to the front face of the sewing machine 81. A trigger cam 94 projects through the wall of the arm 83 to the rear face of the sewing machine 81. In the base plate 82 there is supported a rocking shaft 95 to which is fastened a crank 96 hingedly connected with its free end to the tie rod 89. The afore-described mechanism generally known as stitch regulating gear, is hereinafter denoted as a first gear part 97.

To the rocking shaft 95 there is secured a forked crank 98, in which is hingedly received a beam 99 via a bolt 100. To the beam 99 there is fastened a feed dog 100 having teeth. The feed dog 101 projects through a recess 102 of a throat plate 104 secured to the base plate 82 by means of screws 103. The beam 99 has a semicircularly formed free end 105 movably supported in a link 106. The link 106 is rotatably received in an eccentric lug (not shown) of a shaft 107 pivoted in the base plate 82. In the area of the arm 83, the shaft 107 is provided with a fastened timing belt pulley 108 drivingly connected via a timing belt 109 to the timing belt pulley 86 arranged on the shaft 84. In the free end of the arm 83 there is displaceably supported a needle bar 110, which is drivingly connected to the shaft 84 via a crank gear (not shown). The needle bar 110 carries a needle 111. Moreover, in the arm 83 there is displaceably arranged a presser foot bar 112, to the lower end of which is fastened a semicircularly formed presser foot 113 by means of a screw 114. The presser foot 113 is inwardly formed with a guiding area (not shown) for a timing belt 115 extending above the feed dog 101. The feed dog 101 and the timing belt 115 advance a workpiece 116. Thus, a four-motion-feed dog movement is carried out for advancing the endless workpiece feed member 115. The arm 83 is provided with bearings 117, 118, 119, 120, in which is pivoted a shaft 121. The shaft 121 receives collars 37, 38 interposed between the bearings 117 and 118. The collars 37 and 38 as employed in the preferred embodiment are each formed with toothings 41, 42. Between the collars 37, 38 there are pivoted as already known from the preferred embodiment, the inner rings 47, 64, the shoulders 46, 63 of which are placed back to back. The inner rings 47, 64 are formed with toothings 48, 65. On the inner rings 47, 64 there are each arranged the afore-mentioned one-way couplings 44, 61, which are fitted in a common tubular housing 122. At one end, the housing 122 is formed with a forked member 123 and a radially extending nose 124. The forked member 123 is hingedly connected via a bolt 125 to one end of a bar 126 comprising two single bars 129 flanked by spacers 127 and connected together by rivets 128. The bar 126 extends through a recess 130 of the base plate 82 and is hingedly connected via a bolt 131 to a forked crank 132 secured to the rocking shaft 95 by setscrews 133.

The housing 122 is provided with a pin 134 to which is suspended one end of a spring 135 while the other end is suspended at a pin 136 provided at the bearing 117. In the bearing 117 and a further bearing 137 arranged at the arm 83, there is displaceably supported a connecting rod 138 formed at one end with a thrust piece 140 fastened by a nut 139. The free end of the connecting rod 138 is formed with a cam follower 141 resting against the trigger cam 94. On the shaft 121 between the bearings 118, 119 of the arm 83, there is arranged the clamping member 74 known from the preferred embodiment, which in turn is resting with its outer surface 77 against a recess 142 of the arm 83. To the shaft 121 there is fastened a timing belt pulley 143 receiving the timing belt 115. Finally, a tiltable bracket 144 is pivoted on the shaft 121 and formed with a lever 145 hingedly connected via a bar 146 to the presser foot bar 112 movably received in the arm 83. At the end of the lever 145 there is located a guide member 147 for the timing belt 115. The afore-described elements interposed between the bearings 117 to 120 of the arm 83 form a second gear part 148.

The operation of the modified embodiment may be described as follows:

When operating the sewing machine 81 via the handwheel 85, the shaft 84 is turned so that the fork 88 is swingably driven by the eccentric 87. The tie rod 89 is guided in the guide block 92 by means of the lug 90 and the slide block 91 and initiates via the crank 96 a rocking movement of the rocking shaft 95 according to the double arrow 149. Simultaneously, the shaft 107 located in the base plate 82 is driven. The crank 98 and the link 106 driven by the eccentric lug (not shown) of the shaft 107 impart to the beam 99 a rocking motion, at which the feed dog describes an elliptical path.

For the further description it may be assumed that the feed dog 101 advances the workpiece 116 in a reverse motion, at which the adjusting lever 93 takes in the shift position D. At this instant, the rocking shaft moves in the direction of the arrow 150. The housing 122 supported on the shaft 121 is moved via the crank 132 and the bar 126 in the direction of the arrow 151. During the shift position D of the adjusting lever 93, the connecting rod 138 is in a position so as to displace against the tension of the spring 135 the housing 122 via the thrust piece 140 and the nose 124, into the position as illustrated in FIG. 10 so that the toothings 41, 48 are engaged while the toothings 42, 65 are disengaged. Thus, the collar 37 and the shaft 121 together with the timing belt pulley 143 are carried along the direction of the arrow 151, so that the timing belt 115 also acts at the workpiece 116 feeding the latter backwardly. During the generation of these movements, the inner ring 64 performs an idle motion. By shifting the adjusting lever 93 into the shift position C, on one hand, the first gear part 97 is reversed, so that the feed dog 101 forwardly advances the workpiece 116. Simultaneously, the connecting rod 138 is displaced by the cooperation of the cam follower 141 with the trigger cam 94 and the force of the spring 135, so that the housing 122 is also axially displaced in such a kind that the toothings 41, 48 are disengaged and the toothings 42, 65 are engaged. As to the flexible construction of the bar 126, the driving connection of the housing 122 is maintained during the axial displacement. Now, during the forward feeding phase, the first gear part 97 causes the rocking shaft 95 to move in the direction of the arrow 152. This movement is transmitted via the bar 126 to the housing 122, which now moves in the direction of the arrow 153. The rotary motion imparted to the collar 38 is transmitted to the shaft 121 driving the timing belt 115, which, together with the feed dog 121 forwardly advances the workpiece 116. The operation of the clamping member 74 arranged on the shaft 121 has already been explained in the description of the operation of the preferred embodiment.

The feed gear according to the modified embodiment further may be provided with a rocking drive for the needle bar bearing which may be derived from the rocking shaft 95. Furthermore, the oppositely-arranged one-way couplings may also be combined with additional one-way couplings, which when driven individually and in different phases make possible the generation of a quasi continuous, adjustable and reversible movement. This would offer the advantage that the aforedescribed clamping member improving the function of stepping mechanisms could be eliminated. In a further modified embodiment, thereby, the out-of-phase driven one-way couplings would avoid a non-desired reverse movement of the output shaft.

Having now described the invention with reference to the embodiments illustrated in the drawings, what is desired to protect by Letters Patent is set forth in the appended claims.

What is claimed is:

1. A sewing machine comprising:

a housing including a base plate supporting a workpiece;

a rotating shaft pivotally received in said housing;

stitch forming means including:

a reciprocatingly driven needle and a feed gear reversibly advancing said workpiece with respect to said needle and having:

a first gear part including eccentric means driven by said shaft for generating an oscillatory movement, and a second gear part comprising:

a first one-way coupling means connected by drive means to said first gear part for converting said oscillatory movement into a stepwise movement of a direction, an endless workpiece feed member with a drive connection, reversing gear means, and clutch means including shifting means for alternatively connecting said one-way coupling means or said reversing gear means to said feed member, said reversing gear means comprising a further one-way coupling means similarly structured to said first one way coupling means oppositely-arranged with respect to said one-way coupling means and drivingly connected to said first gear part for converting said oscillatory movement into a stepwise oppositely-directed movement of an opposite direction with respect to said direction.

2. A sewing machine comprising:

a housing including a base plate supporting a workpiece;

a rotating shaft pivotally received in said housing;

stitch forming means including a reciprocatingly driven needle and a feed gear reversibly advancing said workpiece with respect to said needle, and having a first gear part including an eccentric driven by said shaft for generating an oscillatory movement, and a second gear part comprising a one-way coupling with a toothed inner ring and an outer ring drivingly connected by means of a drive means to said first gear part for converting said oscillatory movement into a stepwise motion of a uniform direction, an output shaft pivotally received in said housing, pivotally carrying said toothed inner ring of said one-way coupling and profiled with teeth engagably cooperating with said toothed inner ring, an endless workpiece feed member driven by said output shaft and a clutch including shifting means for alternatively drivingly connecting said one-way coupling or said reversing gear to said feed member, said reversing gear comprising a further one-way coupling structured as said one-way coupling, pivoted on said output shaft in an oppositely directed arrangement and connected by a further drive means to said first gear part for converting said oscillatory movement into a stepwise opposite motion with respect to said motion, the toothed inner ring of said further one-way coupling engagably cooperating with further teeth located at said output shaft.

3. A sewing machine according to claim 2, wherein said drive means for said one-way coupling and said further drive means for said further one-way coupling each is formed with a pitman connecting said first gear part with the outer rings of the oppositely arranged one-way couplings.

4. A sewing machine comprising:

a bracket arm including a base plate supporting a workpiece;

a rotating shaft pivotally received in said bracket arm;

stitch forming means including a reciprocatingly driven needle and a feed gear reversibly advancing said workpiece with respect to said needle, and having a first gear part for generating a reversible oscillatory movement and having eccentric means driven by said shaft and a shift device, and a second gear part comprising one-way coupling means connected by drive means to said first gear part for converting said oscillatory movement into a stepwise motion in a uniform direction, an endless workpiece feed member with a drive connection, reversing gear means, and clutch means including shifting means operably connected to said shift device connecting said one-way coupling means or said reversing gear means to said feed member, said reversing gear means comprising further one-way coupling means similarly structured and drivingly connected to said one-way coupling means and oppositely arranged with respect to said latter for generating a further stepwise uniform motion oppositely directed to said direction.

5. A sewing machine comprising:

a bracket arm including a base plate supporting a workpiece;

a rotating shaft pivotally received in said bracket arm;

stitch forming means including a reciprocatingly driven needle and a feed gear reversibly advancing said workpiece with respect to said needle, and having a first gear part for generating a reversible oscillatory movement including an eccentric driven by said shaft and a shift device, and a second gear part comprising:
an output shaft pivotally received in said bracket arm,
an endless workpiece feed member driven by said output shaft,
drive means for transmitting said oscillatory movement to a housing,
a one-way coupling arranged in said housing for converting said oscillatory movement into a stepwise motion in a uniform direction, said one-way coupling having an inner ring pivotally received on said output shaft,
a reversing gear, and
clutch means including shifting means operably connected to said shift device for alternatively connecting said one-way coupling or said reversing gear means to said feed member,
said reversing gear means comprising a further one-way coupling structured as said one-way coupling and received in an opposite arrangement in said oscillatingly driven housing for generating a further stepwise uniform motion oppositely directed to said direction.

6. A sewing machine according to claim 5, wherein said first gear part further includes a rock shaft, a further eccentric and a feed dog operably connected by link means to said rock shaft and said further eccentric for performing a four-motion-feed dog-movement for advancing said workpiece in combination with said endless workpiece feed member.

7. A sewing machine comprising:
a housing including a base plate supporting a workpiece;
a rotating shaft pivotally received in said housing;
stitch forming means including:
a reciprocatingly driven needle and
a feed gear reversibly advancing said workpiece with respect to said needle and having:
a first gear part including eccentric means driven by said shaft for generating an oscillatory movement, and
a second gear part comprising:
a one-way coupling means connected by drive means to said first gear part for converting said oscillatory movement into a stepwise movement of a direction,
an endless workpiece feed member with a drive connection,
reversing gear means, and
clutch means including shifting means for alternatively connecting said one-way coupling means or said reversing gear means to said feed member,
said reversing gear means comprising a further one-way coupling means similarly structured and oppositely-arranged with respect to said one-way coupling means and drivingly connected to said first gear part for converting said oscillatory movement into a stepwise oppositely-directed movement of an opposite direction with respect to said direction;
said drive connection having an output shaft pivotally receiving inner rings of said oppositely arranged one-way couplings, said clutch means being formed by teeth at said inner rings and by toothed portions profiled at said output shaft alternatively cooperating with said teeth.

8. A sewing machine according to claim 7, wherein said toothed portions are formed at collars secured to said output shaft.

9. A sewing machine according to claim 8, wherein said teeth of collars and said teeth of said inner rings are provided with engagable saw-toothed profiles.

10. A sewing machine according to claim 9, wherein said collars and said inner rings are identically structured.

11. A sewing machine comprising:
a bracket arm including a base plate supporting a workpiece;
a rotating shaft pivotally received in said bracket arm;
stitch forming means including a reciprocatingly driven needle and
a feed gear reversibly advancing said workpiece with respect to said needle, and having
a first gear part for generating a reversible oscillatory movement and having eccentric means driven by said shaft and a shift device, and
a second gear part comprising
one-way coupling means connected by drive means to said first gear part for converting said oscillatory movement into a stepwise movement in a uniform direction,
an endless workpiece feed member with a drive connection,
reversing gear means, and
clutch means including shifting means operably connected to said shift device connecting one-way coupling means or said reversing gear means to said feed member,
said reversing gear means comprising a further one-way coupling means drivingly connected to said one-way coupling means and oppositely arranged with respect to said latter for generating a further stepwise uniform motion oppositely directed to said direction;
said drive connection having an output shaft pivotally receiving inner rings of said oppositely arranged one-way couplings means, said one-way coupling means being formed with a common housing.

12. A sewing machine according to claim 11, wherein each of said inner rings is formed with teeth, said output shaft being profiled with tooth portions alternatively cooperating with said teeth.

13. A sewing machine according to claim 12, wherein said oppositely arranged one-way coupling means are of an equal structure.

* * * * *